US008000486B2

(12) United States Patent
Hildebrandt

(10) Patent No.: US 8,000,486 B2
(45) Date of Patent: Aug. 16, 2011

(54) HEADPHONES FOR 3D SOUND

(76) Inventor: James G. Hildebrandt, Calgary (CA)

( * ) Notice: Subject to any disclaimer, the term of this patent is extended or adjusted under 35 U.S.C. 154(b) by 83 days.

(21) Appl. No.: 10/560,743

(22) PCT Filed: Jun. 16, 2004

(86) PCT No.: PCT/CA2004/000905

§ 371 (c)(1),
(2), (4) Date: Dec. 15, 2005

(87) PCT Pub. No.: WO2004/112423

PCT Pub. Date: Dec. 23, 2004

(65) Prior Publication Data

US 2007/0098198 A1 May 3, 2007

(30) Foreign Application Priority Data

Jun. 16, 2003 (CA) ..... 2432832

(51) Int. Cl.
*H04R 5/02* (2006.01)

(52) U.S. Cl. ..... 381/310; 381/309; 381/74; 381/370; 381/371; 381/382

(58) Field of Classification Search ..... 381/309–310, 381/328, 330, 319, 312, 74, 338, 362, 367, 381/370–371, 376, 72, 75, 183, 151, 71.6, 381/380–382; 181/0.5, 20, 22, 129–130
See application file for complete search history.

(56) References Cited

U.S. PATENT DOCUMENTS

| | | | | |
|---|---|---|---|---|
| 4,682,363 | A * | 7/1987 | Goldfarb et al. | 381/74 |
| 5,459,290 | A * | 10/1995 | Yamagishi | 181/129 |
| 5,684,879 | A | 11/1997 | Verdick et al. | |
| 5,889,875 | A * | 3/1999 | Caron et al. | 381/338 |
| 6,038,330 | A * | 3/2000 | Meucci, Jr. | 381/371 |
| 6,062,337 | A | 5/2000 | Zinserling | |
| 6,084,976 | A * | 7/2000 | Lin | 381/380 |
| 7,082,207 | B2 * | 7/2006 | Rapps | 381/381 |
| 2002/0094094 | A1 * | 7/2002 | Shin | 381/104 |

(Continued)

FOREIGN PATENT DOCUMENTS

CA 2432832 A1 12/2004

(Continued)

OTHER PUBLICATIONS

European Search Report.
U.S. Appl. No. 60/833,775, filed Jul. 28, 2006.
PCT/CA2007/001331 (filed Jul. 30, 2007).

*Primary Examiner* — Devona E Faulk
*Assistant Examiner* — Disler Paul
(74) *Attorney, Agent, or Firm* — K&L Gates LLP

(57) ABSTRACT

Headsets (20, 50, 60, 71) provide surround sound and full 3 dimensional effects to a user to simulate the effects of direction and sound source. Advantages include: surround sound effect without the limitations of Head-Related Transfer Functions, and pinna effect customized to each user's ears; horn shape tube outlets (32) to create an efficient transmission of sound; ability to space the headset speakers (22, 24) away from the user's ear and to maintain sound quality by addition of a chamber (28) behind the speakers (22, 24), with the aid of tube sound guides (23, 25) and the horn shaped outlets; and, no need for electronic hardware to process the electrical signals to create desired effects as placement of the speakers creates the correct timing, and damping material (34) in the tubes between speakers creates a desired intensity drop. Head tracking capability is also provided.

33 Claims, 11 Drawing Sheets

U.S. PATENT DOCUMENTS

| | | | | |
|---|---|---|---|---|
| 2002/0181727 | A1* | 12/2002 | Shen et al. | 381/370 |
| 2003/0103637 | A1* | 6/2003 | Huang | 381/309 |
| 2004/0037444 | A1* | 2/2004 | Redmer et al. | 381/370 |
| 2007/0098198 | A1 | 5/2007 | Hildebrandt | 381/370 |

FOREIGN PATENT DOCUMENTS

| | | | |
|---|---|---|---|
| JP | 57-041095 | * | 6/1982 |
| SE | 518940 | | 12/2002 |
| WO | WO 2004/112423 A2 | | 12/2004 |

* cited by examiner

Sample of using Equalization to compensate for speaker/enclosure/tube system effects

| Freq | Speaker (db) | EQ/amp (db) | Net effect (db) |
|---|---|---|---|
| 50 | 5 | 19 | 24 |
| 100 | 10 | 14 | 24 |
| 200 | 17 | 7 | 24 |
| 400 | 20 | 4 | 24 |
| 800 | 22 | 2 | 24 |
| 1600 | 24 | 0 | 24 |
| 3200 | 20 | 4 | 24 |
| 6400 | 15 | 9 | 24 |
| 12800 | 12 | 12 | 24 |
| 25600 | 6 | 18 | 24 |

HEADPHONES FOR 3D SOUND

FIELD OF THE INVENTION

The present invention relates to headphones generally, and in particular relates to headphones that provide surround sound effects to a user such that the effects of direction and sound source can be simulated.

BACKGROUND OF THE INVENTION

Conventional headphones do not account for the effects of the human outer ear to produce realistic sounds and typically make no attempt to produce the sound cues needed to locate the direction of the sound. In a theatre type application, the sound signals from surround sound are created to be played on speakers that are in specific locations in the room. For example, one signal is created to be played on a speaker that is in front of the listener and about 45 degrees to the left. Another is created to be played on a speaker that is about the same distance from the listener but behind the listener and at approximately 60 degrees from directly behind the listener. The angle and distance from the listener creates the correct timing, intensity, pinna effect and head tracking effects to create the intended results. These effects are difficult to reproduce in headsets, due to the limited space that is available for speaker placement, and the need for compact packaging. Further, in conventional headphone design, if the speaker is not placed within a few millimeters of the ear, then the sound quality greatly diminishes.

To provide the effects of surround sound, the normal methods that humans use to locate the direction of sound have to replicated. There are four main methods that humans use, all of which are used in concert as no one method alone is adequate to pinpoint the source of the sound.

1. The time difference of the sound reaching each ear. If the sound is directly ahead or behind the listener, there is no sound difference between the left and right ears receiving the sounds. If the sound is directly to the right of the listener (at 90 degrees from the front of the head) the right ear hears the sound approximately 0.5 ms before the left ear. So, any angle between 0 and 90 creates a unique timing difference. It does not however, distinguish between the angle in front of the ear and the same angle to the rear of the ear. Furthermore, the time difference between the ears also creates a phase difference between the signals at each ear. The time difference is the same for all frequencies but since the wavelengths vary, the phase varies with frequency.
2. Intensity difference. Sounds on one side of the head are louder on that side of the head. High frequency sounds are blocked by the head more than the low frequency sounds so the quality of the sound is altered to the ear opposite the sound source.
3. Pinna effect. The pinna is the outer ear. Sounds coming from the front of the head are reflected by the outer ear to the ear canal. Some of the sound frequencies are reflected more efficiently than others, depending on the ear size and shape, and depending on the direction of the sound. This is the main method for distinguishing between front and rear located sounds. Rear sounds are somewhat blocked by the outer ear and are muffled, front sounds have some of the higher frequencies amplified and sound 'crisper'. Since ear shape and size is unique to each person (and for each person may even be different on left and right sides) the frequencies being amplified are different for each person.
4. Head tracking. Any remaining ambiguity in the use of the above methods is greatly reduced by the person rotating the head. A turn of the head changes the angle of the sound relative to the ears and so all of the above cues, timing, intensity and pinna effect also change. The change in the cues then gives the brain a second point of view of the sound location, and greatly helps to pinpoint the sound. As little as a 5 degree turn of the head can be enough to fully pinpoint the direction of the sound.

The prior art for surround sound in headsets can be described to be in one of two categories.

The first category includes techniques where physical modifications to the locations of speakers are used to create surround sound, and in some cases the speakers are connected with tubes. Horn tubes are well known, but have not previously been applied to headsets. The horn tubes make the transmission of the sound more efficient and reduce the need for added amplification.

The second category includes techniques that use one speaker at each ear and use electronic methods to alter the signals intended for the speakers to create a virtual surround sound. The methods are called Head-Related Transfer Functions (HRTF); The HRTF alter the timing and intensity of the signals as described in the first two methods above. They also modify the sound so as to mimic the pinna effect. However, since every person has a unique shape to their ears (purportedly as unique as fingerprints), the way that each person has learned to detect the differences due to location are also unique to each person. The HRTF methods attempt to create a modification to sound that many people recognize as their sound cues. However, the methods can not adapt to every person and so are limited. Other prior art describes the use of head tracking in headsets and uses a device (e.g., gyro) to track the rotation of the head and to alter the signals to the speakers to reflect the head rotation. This requires a processor to modify the signals to replicate the desired effect, while in the present invention the signals are left unchanged.

Accordingly, it is a object of the present invention to provide a surround sound headset that overcomes the disadvantages of the prior art. It should produce sounds with such timing, intensity and pinna effects as a listener would expect to hear naturally, no matter the shape and size of the listener's pinna.

SUMMARY OF THE PRESENT INVENTION

The headset of the present invention has important features that provide advantages over the prior art:

1. Surround sound and full 3 dimensional effects without the limitations of the Head-Related Transfer Functions (HRTF) noted earlier. The pinna effect is customized to each user's ears.
2. Horn shape tubes to create an efficient transmission of sound. The use of horn drivers has been known but never applied to headsets.
3. The ability to overcome the restriction of having to place the headset speaker within a few millimeters of the ear and maintain the sound quality. This is done largely with the addition of a chamber on the rear of the speaker and is aided with the tube sound guide and the horn terminus. This technique improves the sound from any small speaker to the extent that it even makes it practical to use headset speakers as room speakers.
4. No need for electronic hardware to process the electrical signals to create the timing, intensity, pinna effects, or head tracking effects. The placement of the speakers in the present invention creates the correct timing. Use of damping material in the tubes between the speakers creates the intensity drop as is normally heard for sounds originating to one side of the head with the higher frequencies damped more than the low frequencies.

5. The ability to combine the advantages of the rear speaker chamber and tube sound guide with standard electronic methods to produce a compact headset and superior sound.

In one aspect the invention provides a headset having speakers that are placed in locations in tubes such that the timing and intensity location cues are correctly produced. The sound from the headset's front speakers is emitted from the ends of the tubes in front of the user's ears and so that the pinna effect for frontal sounds is correctly reproduced for every person. No matter what shape and size of the outer ear, each person hears the front sounds as they are used to hearing front sounds. Likewise with the sounds from the headset's rear speakers is emitted from behind the ears, and so the user hears rear sounds as the user is used to hearing them.

In another aspect the invention provides a headset that produces sounds such that timing, intensity and pinna effects are all produced in the way that every person is used to hearing those signals, no matter the shape and size of their pinna.

In yet another aspect the present invention provides a head tracking capability. In the prior art, head tracking in certain types of headsets uses a device (e.g. a gyro) to track the rotation of the head and to alter the signals to the speakers to reflect the head rotation. The prior art does not show head tracking capabilities for the type of headset of the present invention. In this invention the sound signals are left unchanged. The headset rests in a stationary position, for example, on the user's shoulders, and the user's head can move (right or left by an amount of up to 20 degrees) relative to the relatively fixed points of the tube ends.

BRIEF DESCRIPTION OF THE DRAWING FIGURES

Embodiments of the invention will now be described, by way of example only, with reference to the accompanying drawings, wherein.

Figure 8:
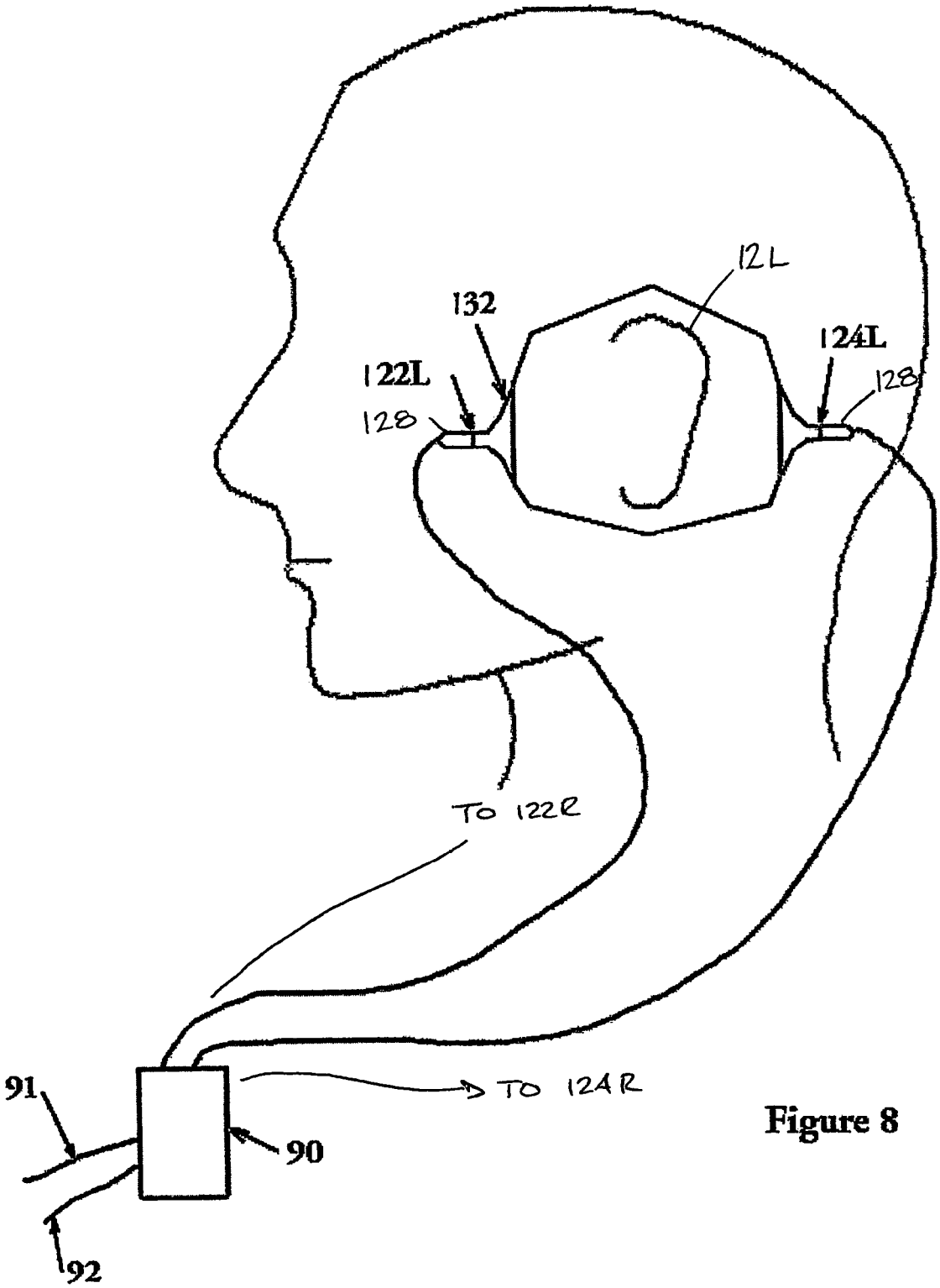
Figure 9:
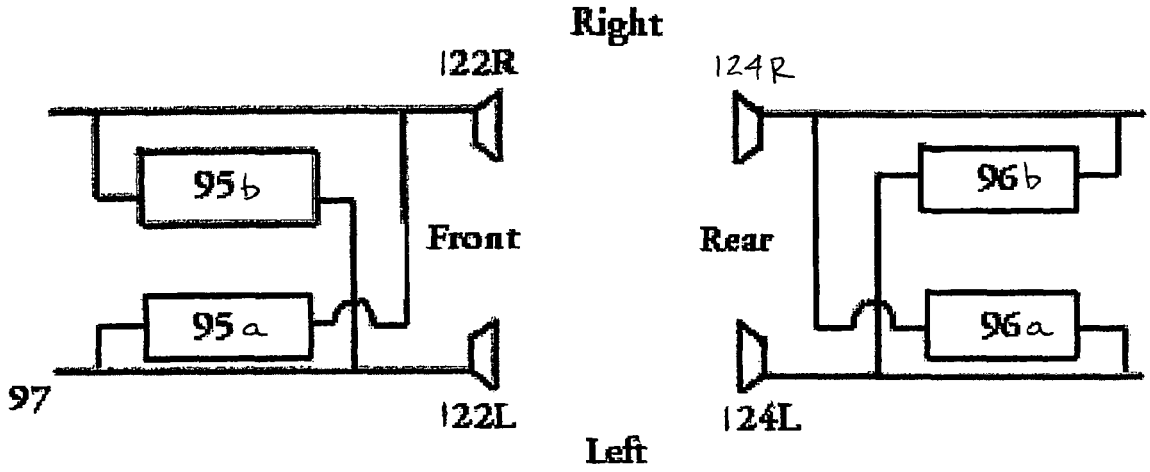
Figure 10:
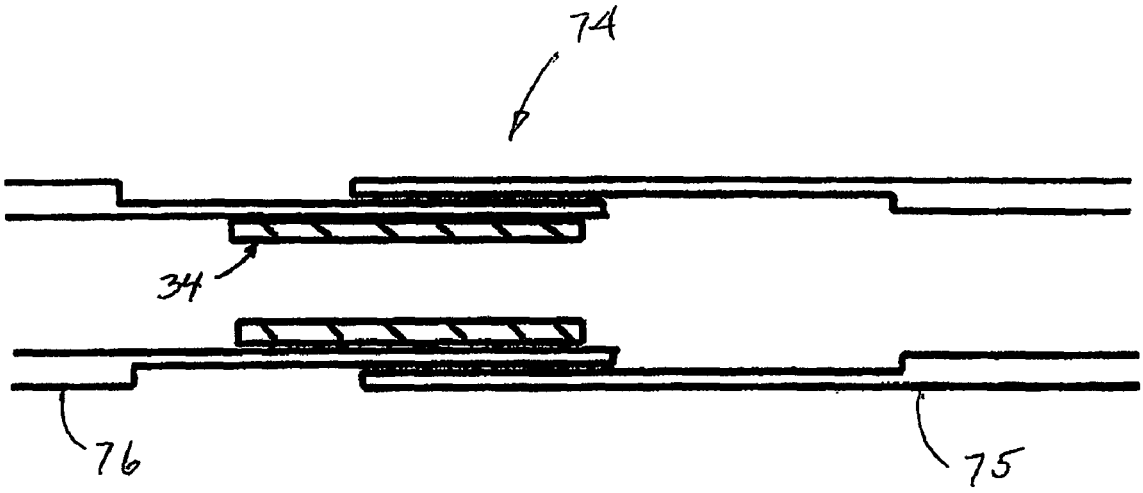
Figures 11A, 11B:
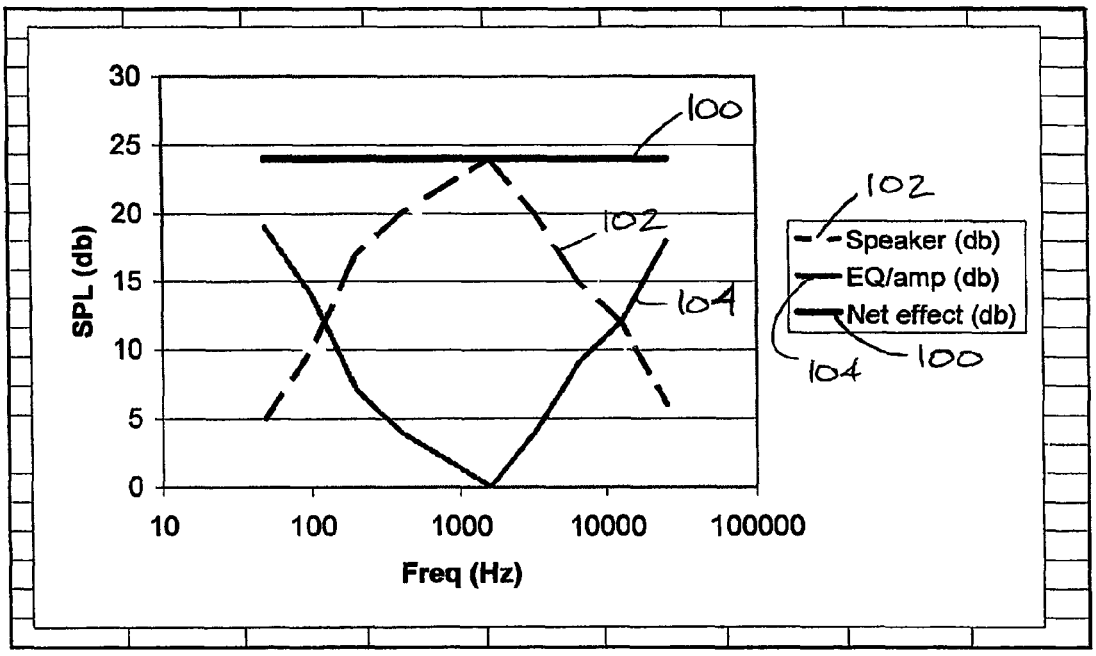

FIGS. 8 and 9 relate to another embodiment of the present invention combining the headset's acoustic features (in particular to provide the desired pinna effect) and electronic processing;

FIG. 10 is a detailed view of one embodiment of a sliding joint within a headset tube; and, FIG. 11*a* is a graph and FIG. 11*b* is a related chart to illustrate yet another embodiment of the invention incorporating an equalizer.

DESCRIPTION OF PREFERRED EMBODIMENTS

The present invention provides a headset apparatus suitable for providing a surround sound effect. The headset provides the user (also referred to herein as the "listener") with the ability to locate the direction from which sounds are originating anywhere in 3D space, much like room speakers, and provides a dynamic quality of sound. After using the headsets described herein, users describe other headsets as sounding "dead'. The present invention also provides a reduced "in-the-head" fatigue that is commonly experienced with prior art headsets. When describing the present invention, all terms not defined herein have their common art-recognized meanings.

In the present invention speakers are placed in hollow tubes at preset locations to produce desired timing and intensity location cues. The sound from front speakers is emitted from the ends of the tubes in front of the user's ears, and so the pinna effect for frontal sounds is correctly reproduced for every user. No matter what shape and size of the outer ear, each user hears the front sounds as the user is used to hearing front sounds without such headset. Likewise with the sounds from rear speakers being emitted from behind the ears, a user hears rear sounds as they would be heard without such headset.

Figure 1:
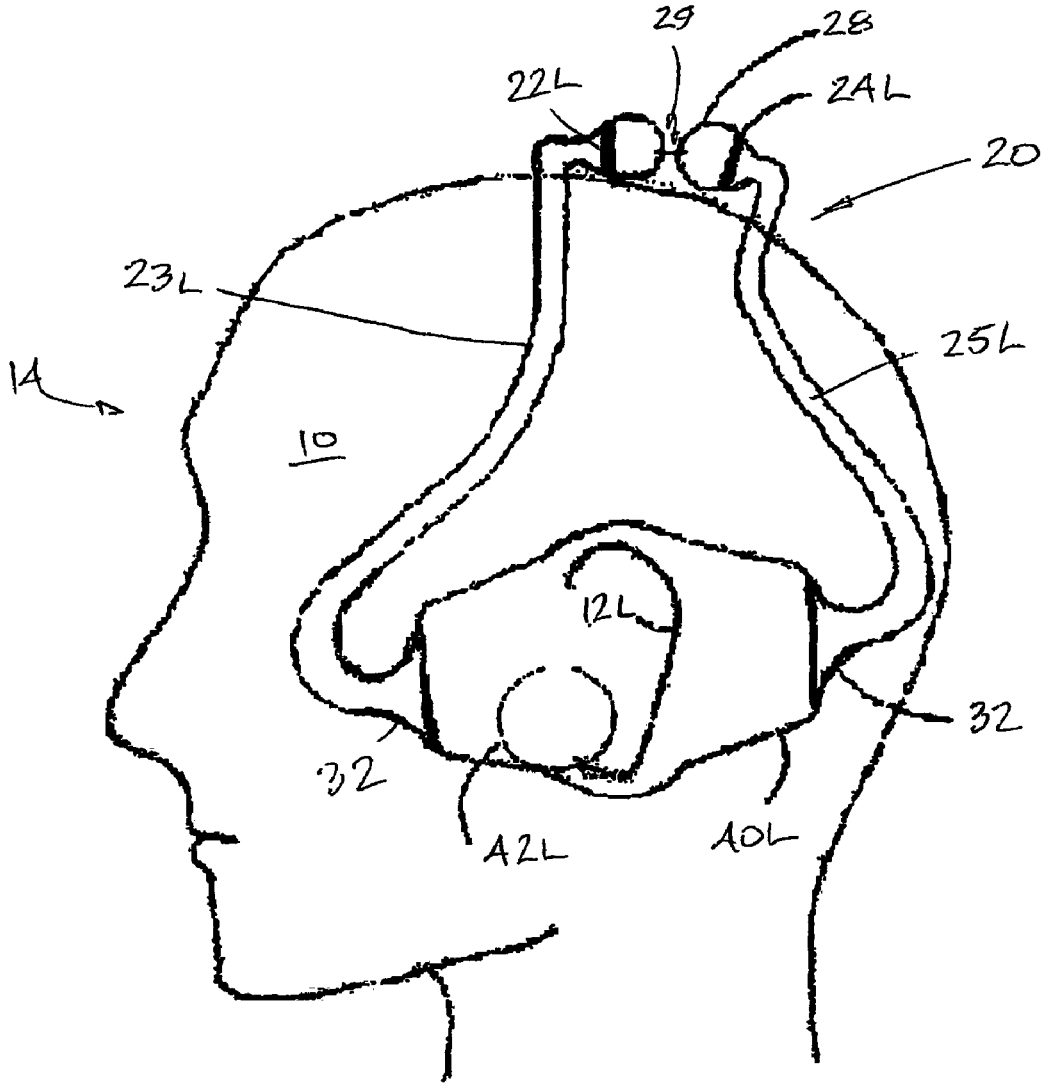
FIG. 1 shows a side view of the headset according to a first embodiment of the present invention with the tube paths formed to meet at the top of the user's head.
Figure 2:
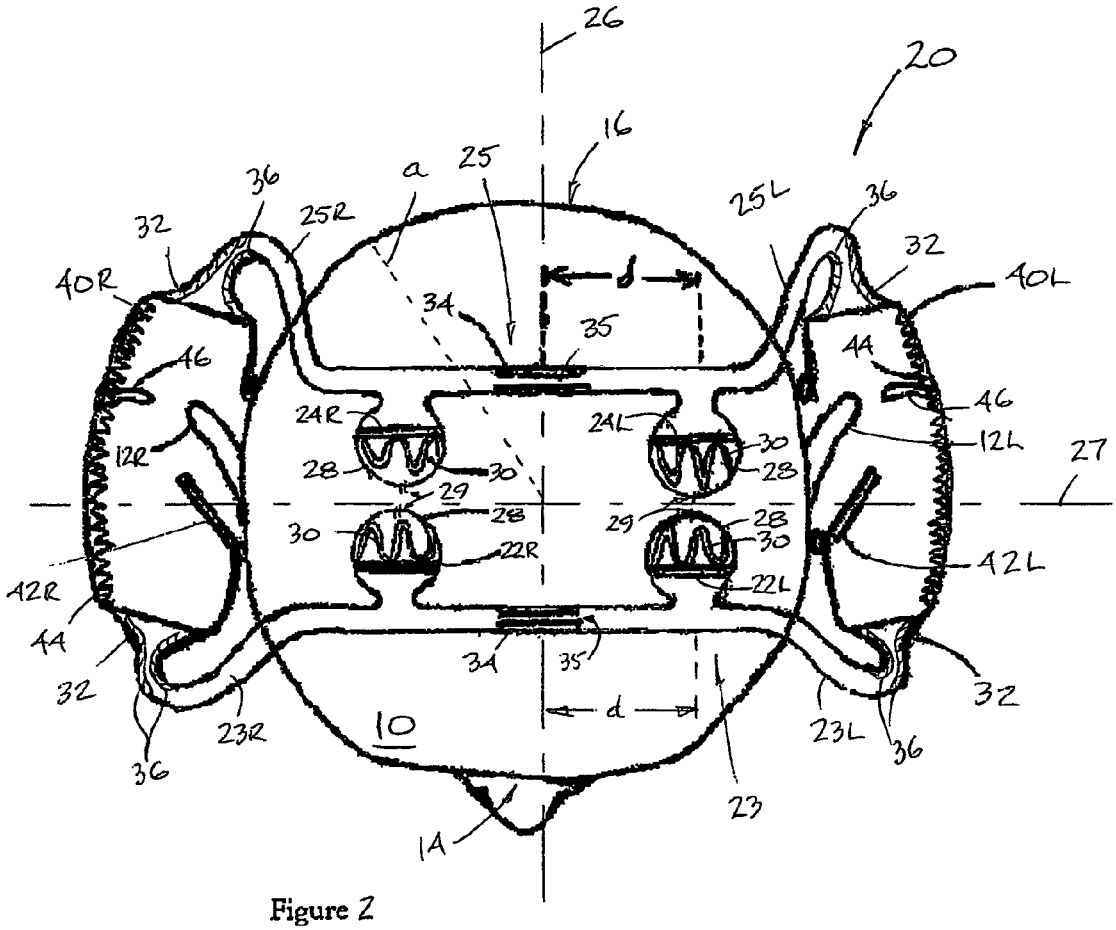
FIG. 2 is a top view of the headset of FIG. 1.

Referring now specifically to the first embodiment shown in FIGS. 1 and 2, the headset (generally designated by the reference numeral 20) is shown seated on a user's head 10 and consists of at least one speaker and tubing to connect the acoustic path from a given speaker to one or both of the user's ears. This embodiment provides four speakers (which will also be referred to herein as "location" or "position generating" speakers) and associated tubing sections, namely left and right front speakers 22L and 22R (considered from the user's perspective) having respective left and right front tubing sections 23L and 23R, and left and right rear speakers 24L and 24R having respective left and right rear tubing sections 25L and 25R. As the speaker and tubing arrangement in this embodiment should be generally symmetrical about the illustrated longitudinal and transverse axes 26 and 27, one speaker and tubing arrangement will be referred to primarily to illustrate the structure and mode of operation of the present invention, and the same reference numerals will be used for the same or substantially similar components.

Referring to the speaker/tubing arrangement 22L, 23L, the speaker 22L is housed in either an acoustically sealed or a ported chamber 28.

The portion of the chamber on the backside of the speaker contains sound absorbing material 30 to reduce the echo effect in the chamber. The tube 23L may be of a constant inner diameter from its connection with the speaker toward its outlet 32 at the ear cup 40L, or alternately the tube may be shaped with an increasing diameter from speaker connection to the outlet. The outlet 32 has a flare or horn shape, as illustrated. Sound absorbing material 34 is placed within the tube 23L, at its juncture with tube 23R (i.e. intermediate the front speakers 22L, 22R), to make the speaker 22L sound louder in the near side ear cup 40L for the user's near side ear 12L than in the far side ear cup 40R. The material 34 need not block the entire tube as an open channel 35 of desired size may be provided to control the amount of sound that may travel between the left and right speakers The material 34 acts to decrease mostly the amplitude of the higher frequencies in the same way that occurs in room acoustics where the head acts to block mostly the high frequencies passing from one side of the head to the ear on the opposite side of the head. Further sound absorbing material 36 is also used at the ends of the tubes 32 to reduce the standing waves that can occur with this design. The ends of the rear tubes will use more sound absorbing material than the front tubes to emulate the fact that sounds from the rear on one's head are damped by one's head of hair. The material 36 may alternately consist of a pousous material, such as low density foam or felt for example, that fills the end of the tube to provide the desired effect.

The placement of the speakers from the centreline 26 of the front and back tubes 23, 25 is now described. Each speaker 22L, 22R, 24L, 24R represents a sound source at a given angle from the front 14 of the head. For example, if a speaker were to represent a sound source directly in front of the listener, the speaker would be located at the centerline of the front tube 23. However, for a speaker to represent a sound source at a given angle from the front of the head, the speaker should be located at a distance "d" along the front tube 23 from the centerline 26 of the head, where:

$$d=a(\text{theta}+\sin(\text{theta}))/2$$

where:

a=the radius of the head theta=the angle, (in radians) of the source that the speaker represents.

For speakers behind the ears the same formula is used with the angle being measured from a line extending directly behind the head along the centreline 26.

The length of each tube section 23L, 23R, 25L and 25R between the respective speaker and the user's ears (on the near side) can be any length as long as the left and right tube sections are the same length.

The rear tubes 25L, 25R each end with a horn 32 on respective ear cups 40L, 40R such that the horn is behind the user's respective ear 12L, 12R and points toward the back of the ear. Each of the front tubes 23L, 23R likewise end with a horn 32 that is placed in front of the user's ear and points toward the front of the ear.

Additional speakers 42L, 42R are provided in respective ear cups 40L, 40R for each ear. These speakers are located close to, and in front of, the ear and have the bass signal sent to them. It should be understood that the ear cups are optional in that the tubing outlets 32 and additional speakers need not be located within a closed environment, but may be open to the ambient near the ears. However, an advantage of having enclosed ear cups is their ability to block or reduce unwanted sounds from the surroundings that would otherwise interfere with the sounds from the headset. The inside surface of the ear cups may be covered in a sound absorbing material 44 to further reduce interference from outside noise and echo within each ear cup. Each ear cup may also be perforated to reduce the echo within each ear cup. Further, each ear cup may optionally have an insert 46 (FIG. 2) to exaggerate the front/rear distinction with a vertical panel in line with the ear pinna. Yet further, the ear cups may have ports on top and bottom to enhance air convection through the cup and avoid overheating the ears, thus enhancing comfort for extended usage.

Figure 3:
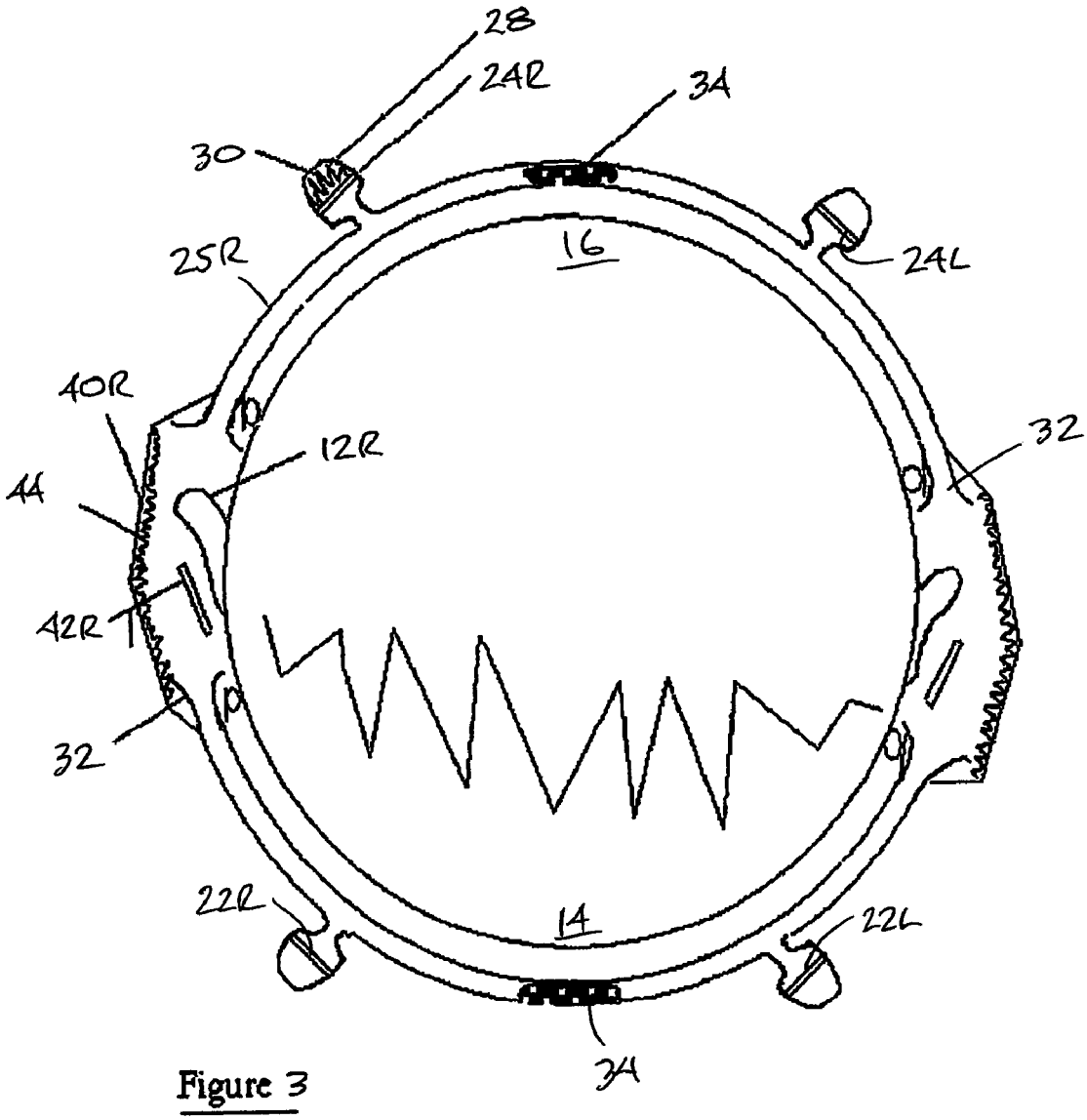
FIG. 3 shows a top view of the layout of the headset according to a second embodiment of the present invention where the tube paths are formed to meet at the front and back of a user's head.

FIG. 3 shows another embodiment of the headset with the tubes formed to meet at the front 14 and back 16 of the user's head, and extending generally in a horizontal or other plane which encompasses the ear cups 42L, 42R. This embodiment demonstrates that the tube path may be formed to any desired shape, as long as the earlier noted distances and configurations (such as the distance "d" and the distance from the speaker to tube outlet 32) are maintained. FIG. 3 also illustrates that the sound absorbing material 34 between the speakers may block the entire inside portion of the tubing and further reduce sound travel between the left and right side speakers.

An important aspect of the present invention is that it takes the sound signals that would normally be sent to a surround sound speaker system (e.g., 4 channel, 4.1, 5.1, 6.1, etc.) and accurately creates the sound cues in a headset so that the user can clearly locate the direction of the sounds. For 4-channel sound, 4 location headset speakers (denoted earlier as 22L, 22R, 24L, 24R) should be used. For 5.1 and 6.1 sound, 5 and 6 location speakers, respectively, should be used. Two bass speakers (42L, 42R) may be used, one placed close to each ear, in any of these alternate designs. The position generating headset speakers are placed at specific locations in the tubes to create the correct perception of sound location. Humans apparently can not tell the direction of bass sounds, so the bass speakers do not have to be located at strategic locations in the tubes, but rather can be close to the ears.

Figure 7:
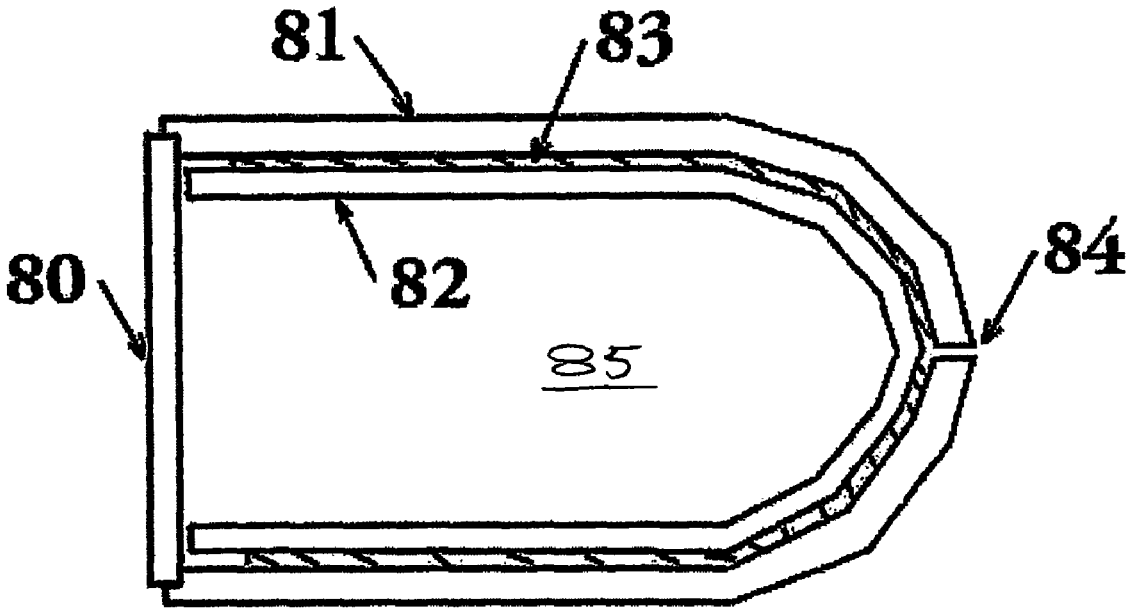
FIG. 7 is a detailed view of one embodiment of a vented rear speaker chamber which is acoustically sealed.

Referring now in greater detail to another important aspect of the invention, namely the acoustically sealed chamber 28 noted earlier, each chamber is located behind a respective position generating speaker 22L, 22R, 24L, 24R as shown in FIGS. 1-3 to improve the sound generated by the speaker. The larger the chamber, the greater the improvement of the bass sounds of the speaker. The chamber forms an enclosure whose length (i.e. perpendicular distance away from the speaker) may vary from 0.25" (6 mm) to 10" (254 mm) or longer. Each chamber has sound absorbing material 30 for reducing the echo effect within. Each chamber may be ported or can be acoustically sealed. If it is acoustically sealed, it is otherwise vented to ambient to allow for atmospheric pressure changes to equalize pressure between the front and the rear of the speaker. The vent 29 consists of a small hole at the far end of the chamber opposite the speaker which has a seal that prevents sound waves from passing, yet allows the slow passage, or leakage, of air. There are several ways to block the acoustic waves and allow the slow leakage of air. One method is to provide a thin tube mounted to the hole so that the tube creates resistance to the oscillation of air, yet allows the equalization of slowly changing air pressure. FIG. 7 shows one embodiment of the rear speaker chamber with a vent which is acoustically baffled. The cavity 85 behind the speaker 80 is baffled from vent 84 by an inner dome 82. Between the chamber wall 81 and the inner dome 82 is a layer of porous sound absorbing material 83 which damps the acoustic waves yet allows equalization of atmospheric pressure. If the chamber is ported the hole shape and size can be tuned to amplify the desired low frequencies, and no venting is required since the port allows the pressure equalization.

For present purposes, a "vented" chamber refers to a chamber which is designed to allow the air pressure to slowly equalize (say over the span of several seconds or minutes) but where the acoustic waves are largely blocked. So, acoustically it performs as if it were sealed. A "ported" chamber is a chamber that is designed with an opening that is tuned to perform a given function with the acoustic properties of the chamber. A ported chamber may appear to have a simple hole. A ported chamber may have a hole that is designed to have a diameter, length and shape along its length to perform an amplification of given frequencies while also being aerodynamically shaped to minimize the turbulence of the air (and hence the hiss) as the acoustic waves pass through the port.

Figure 4:
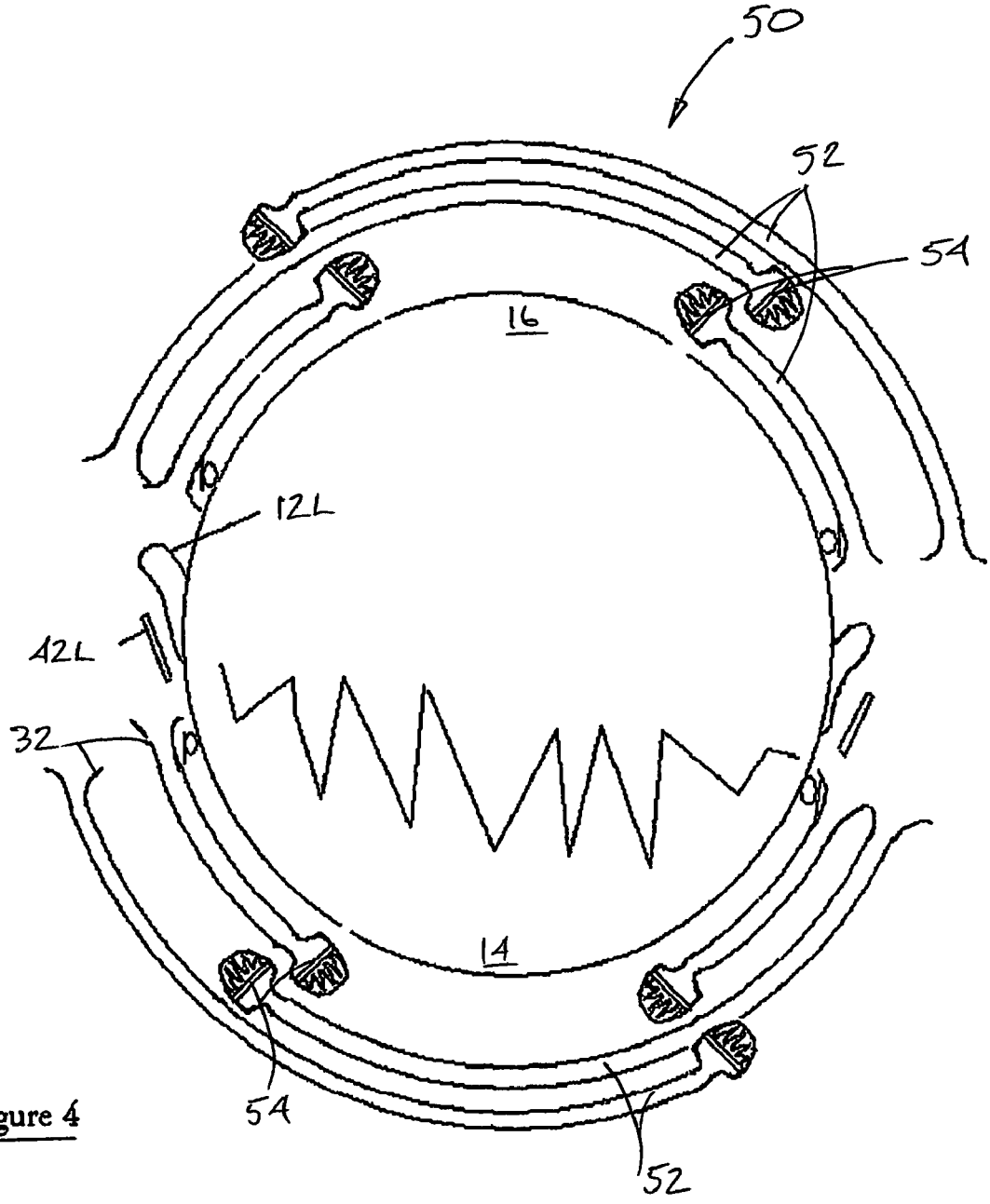
FIG. 4 shows a third embodiment of the headset having separate tubes for each speaker to the user's ears.
Figure 5:
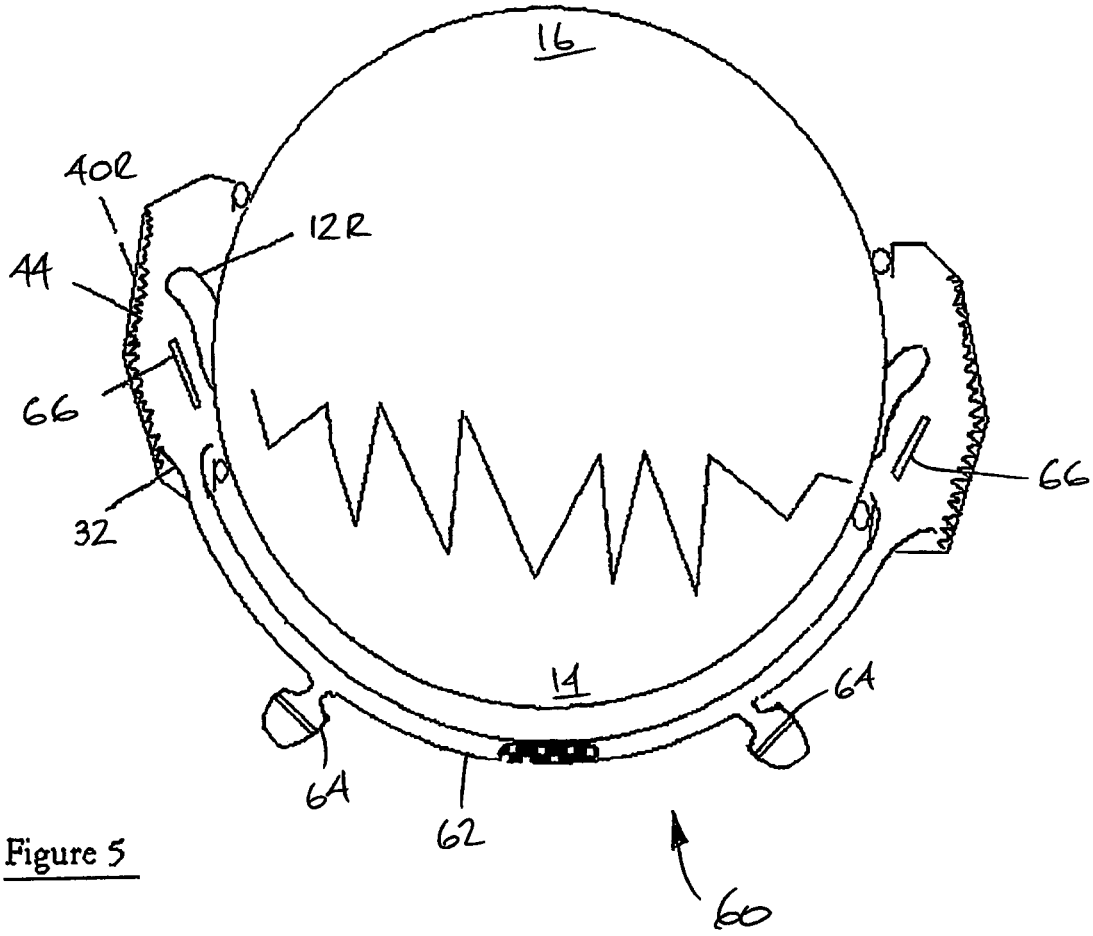
FIG. 5 shows a fourth embodiment of the headset with the front tube replacing the rear speakers and no rear tube where the rear signals are sent directly to the speakers at the user's ears.

Other embodiments of the invention are illustrated in FIGS. 4 and 5. In the headset 50 of FIG. 4, a separate, or distinct, tube 52 is provided as a dedicated passageway from a given speaker 54 to the user's ear. This eliminates the need for the T connections between speakers and tubes (as in the FIG. 1-3 embodiments), but is otherwise undesired as it requires two speakers for every sound source location (one ducted to the left ear and one ducted to the right ear).

In the headset 60 of FIG. 5 only front tubing 62 and front location speakers 64 are provided. The sound from the omitted rear tubing and speakers is simulated by sending appropriate signals directly to the additional speakers 66 at the ears. This embodiment adopts or mimics a surround configuration where rear speakers are located beside the listener and only slightly behind the listener.

Further variations of the present invention may now be appreciated. In one variation a speaker with a horn (similar to 32) may be placed above and/or below each user's ear and pointing towards the ear to simulate sounds from above (e.g. an airplane flying over) or below the user. Another variation may have the ends of the tubes oriented at specific angles to the ear (either in addition to or instead of being placed in front of and behind the ear) and which are coordinated with the source of sound. For instance, in systems with more than 4 speakers, there may be speaker outlets front and rear as well as speaker outlets for specific angles in front and rear, and in some cases with height angles (i.e. at angles above the ear). Yet another variation may have one location speaker per ear in a short tube with a horn placed in front and behind the ear. The sound timing, intensity and cross-feed would then be controlled by electronic delays and filters. This variation should provide a more compact headset and take advantage of the listener's own pinna shape to modify the sounds, but has the disadvantage of requiring electronic processing to produce the timing, intensity and cross-feed effects.

An example employing electronic processing is illustrated in FIG. 8 which shows the region around the left ear cup with an electronic control and two speakers per ear. The location generating speakers 122L and 124L are located in front of and behind the ear 12L, respectively, and employ a rear chamber 128 similar to the earlier embodiments. A short length horn 132 is used in front of each speaker 122L, 124L. An electronic processor 90 receives the normal multichannel sound signals, 91, 92 from a signal source. Referring to FIG. 9 which shows the wiring within the electronic processor 90, a signal 97 for the left front speaker 122L is sent to two paths, namely directly to the left front speaker 122L, through a circuit 95*a* to the right front speaker 122R which creates an approximate 0.5 ms delay (the actual amount depends on the size of the head size that is being simulated), and through a circuit 95*b* to the right front speaker to modify the frequency character to simulate the blockage that the right ear experiences due to a sound from the left front position. The rear channels are modified in a similar manner with circuits 96*a* and 96*b*, but the type of frequency modification is changed since it is representing sound coming from behind the head and this is more damped due to the presence of hair at the back of the head. These modifications in frequency are documented in prior art, as is the electronic technique to implement it.

The delay time for sounds from one side depends on the size of the head. People with small head size, for example children, experience a shorter delay time than people with large head size. The delay time can be fine tuned as an adjustable feature within the electronic controls. In the method with no electronics, such as the use of the connecting tubes, an adjustment can be provided by a slider joint that lengthens or shortens the distance between the left and right speakers. FIG. 10 shows a detail of the slider joint 74 located in the vicinity of the sound absorbing material 34 that is placed between the right and left speakers. This slider joint is preferably included for both the front tubes and the rear tubes. In the version shown the left tube 76 of the slider joint (within which the sound absorbing material 34 is located) slides inside the right tube 75.

In yet a further variant of the invention an equalizer is used to compensate for limitations in the speaker quality and possibly to compensate as well for limitations in the speaker enclosure, tube and horn design. FIGS. 11*a* and 11*b* illustrate the equalizer's effect. The desired outcome for an audio system is a relatively flat frequency output 100. However, all speakers 102 have limitations in what they can achieve and generally are unable to produce the frequencies in the lower and higher frequencies. Therefore, an equalizer 104 may be used to amplify the signal of the frequencies that the speaker has trouble with to produce the relatively flat net output 100.

Figure 6:
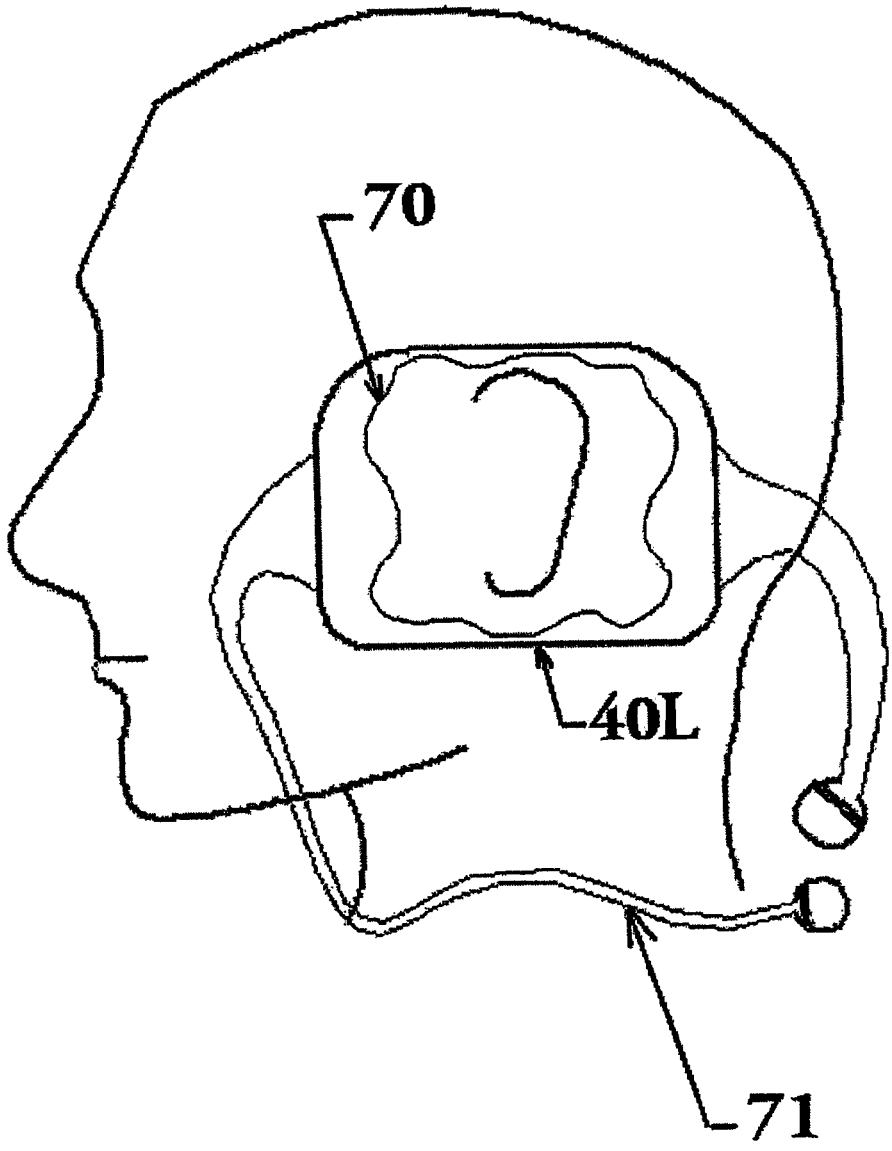
FIG. 6 shows a fifth embodiment with the headset resting on the user's shoulders and allows for the head tracking feature.

FIG. 6 shows yet another variation where the body of the headset 71 (i.e. the speakers, tubes and horns) may rest stationary on the user's shoulders. The horns are adjusted to be at the same horizontal plane as the ears. The horns are in a similar position as in the other configurations. The sound sources may then be held stationary while the head is allowed to rotate. This can be either without the use of the optional ear cups 70, or if using the ear cups, the ear cups use a slider or flexible connection between the ear cup and the stationary horn outlets. The head can pivot with respect to the headset to provide a head tracking ability. Any ambiguity of the direction of the sound source is omitted when the user's head is allowed to move and change the timing and intensity of the sound reaching the ears.

In greater detail, the headset rests in a stationary position, for example, on the user's shoulders, and the user's head can move (right or left by an amount in the range of 20 degrees) relative to the relatively fixed points of the tube ends. For example, if the user head turns to the right, the left ear goes forward, closer to the front left horn end, and the right ear goes rearward, closer to the rear right horn end. The ears also rotate so that the left ear 'opens' more to the left front horn end, and the right ear rotates slightly away from the right front horn end. This changes the sound timing, intensity and pinna effect in the same way that normal head rotation changes these directionality cues.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below.

I claim:

1. A headset apparatus comprising:

at least first and second speakers, each speaker comprising a speaker chamber extending posteriorly therefrom;

at least one first tube connected adjacent a first end thereof anterior to the first speaker;

at least one second tube connected adjacent a first end thereof anterior to the second speaker;

a first outlet at a second end of the at least one first tube for positioning the at least one first outlet at a first position adjacent a user's first ear; and a second outlet at a second end of the at least one second tube for positioning the at least one second outlet at a second position adjacent a user's second ear;

wherein the at least one first tube is continuous with the at least one second tube at respective first ends thereof and the first and second speakers are positioned between the first and second outlets on either side of and a distance from the centerline of an acoustic path formed by the first and second tubes such that a tube length between the first speaker and the first outlet is less than a tube length between the first speaker and the second outlet, and a tube length between the second speaker and the second outlet is less than a tube length between the second speaker and the first outlet, and further wherein the tube length between the first speaker and the first outlet is substantially the same as a tube length between the second speaker and the second outlet, and the tube length between the second speaker and the second outlet is substantially the same as a tube length between the first speaker and the first outlet.

2. The headset apparatus of claim 1, wherein the chamber is an acoustically sealed, ported or vented chamber.

3. The headset apparatus of claim 1 further comprising ear engaging members for housing the first and second outlets.

4. The headset apparatus of claim 1 wherein the first and second outlets each flare outwardly in a direction away from the first and second tubes respectively.

5. The headset apparatus of claim 1 wherein the chamber is a vented or ported chamber.

6. The headset apparatus of claim 1 wherein the chamber is provided with sound absorbing material on a rearwardly disposed interior surface thereof

7. The headset apparatus of claim 1 wherein at least one of the first and second tubes is provided with sound absorbing material therein between a respective first end thereof and a respective first or second speaker.

8. The headset apparatus of claim 7 wherein the sound absorbing material substantially blocks the at least one of the first and second tubes.

9. The headset apparatus of claim 7 wherein the sound absorbing material partially blocks the at least one of the first and second tubes.

10. The headset apparatus of claim 1 further comprising at least one bass speaker adjacent the user ear.

11. The headset apparatus of claim 10 wherein the at least one bass speaker is housed within an ear engaging member.

12. The headset apparatus of claim 3 wherein the ear engaging members are provided with sound absorbing material on an inner surface thereof.

13. The headset apparatus of claim 3 wherein the ear engaging members are perforated.

14. The headset apparatus of claim 1 wherein the at least one first and second speakers and the at least one first and second tubes are positioned generally on top of a user head or in a substantially horizontal plane generally at sides of a user head.

15. The headset apparatus of claim 1 comprising four or more speakers.

16. The headset apparatus of claim 15 comprising at least 4 speakers, wherein:

a third tube is connected adjacent a first end thereof to a third speaker, a second end of the third tube terminating at a third outlet for positioning at a third position adjacent the user's first ear, and;

a fourth tube is connected adjacent a first end thereof to a fourth speaker, a second end of the fourth tube terminating at a fourth outlet for positioning at a fourth position adjacent the user's second ear, wherein the third tube is continuous with the fourth tube at respective first ends thereof and the third and fourth speakers are positioned between the third and fourth outlets on either side of and a distance from the centerline of an acoustic path formed by the third and fourth tubes such that a tube length between the third speaker and the third outlet is less than a tube length between the third speaker and the fourth outlet, a tube length between the fourth speaker and the fourth outlet is less than a tube length between the fourth speaker and the third outlet, the tube length between the third speaker and the third outlet is substantially the same as the tube length between the fourth speaker and the fourth outlet and the tube length between the third speaker and the fourth outlet is substantially the same as a tube length between the fourth speaker and the third outlet.

17. The headset apparatus of claim 16, wherein the first and second speakers are front-left and front-right speakers and the first and second tubes connected adjacent thereto terminate in the anterior portion of left and right ear cups respectively, and wherein, the third and fourth speakers are rear-left and rear-right speakers and the third and fourth tubes connected adjacent thereto terminate in the posterior portion of left and right ear cups respectively.

18. The headset apparatus of claim 16, wherein the third tube is continuous with the fourth tube at respective first ends thereof such that tube paths of the third tube and the fourth tube are formed to meet intermediate the third and fourth speakers.

19. The headset apparatus of claim 1 further comprising an electronic controller to control emissions of the first and second speakers.

20. The headset apparatus of claim 3 further comprising a slider joint between the ear engaging members and the first and second outlets for enabling adjustment of a connection length between the ear engaging members and the first and second outlets when the user ear is moved relative to the headset apparatus.

21. The headset apparatus of claim 1, wherein the at least one first tube is continuous with the at least one second tube at respective first ends thereof such that tube paths of the at least one first tube and the at least one second tube are formed to meet intermediate the first and second speakers.

22. The headset apparatus of claim 2 further comprising at least one center speaker connected at the centerline of the acoustic path formed by the first and second tubes or the third and fourth tubes.

23. A headset apparatus for b 3D sound comprising:

first, second, third and fourth position generating speakers, each comprising a speaker chamber extending posteriorly therefrom;

a first tube connected adjacent a first end thereof anterior to the first speaker, a second end of the first tube terminating at a first outlet for positioning at a first position adjacent the user's first ear;

a second tube connected adjacent a first end thereof anterior to the second speaker, a second end of the second tube terminating at a second outlet for positioning at a first position adjacent the user's second ear;

a third tube connected adjacent a first end thereof to the third speaker, a second end of the third tube terminating at a third outlet for positioning at a second position adjacent the user's first ear, and;

a fourth tube connected adjacent a first end thereof to the fourth speaker, a second end of the fourth tube terminating at a fourth outlet for positioning at a second position adjacent the user's second ear, wherein the first tube is continuous with the second tube at respective first ends thereof and the first and second speakers are positioned between the first and second outlets on either side of and a distance from the centerline of an acoustic path formed by the first and second tubes such that a tube length between the first speaker and the first outlet is less than a tube length between the first speaker and the second outlet, and a tube length between the second speaker and the second outlet is less than a tube length between the second speaker and the first outlet, and further wherein the tube length between the first speaker and the first outlet is substantially the same as a tube length between the second speaker and the second outlet, and the tube length between the second speaker and the second outlet is substantially the same as a tube length between the first speaker and the first outlet; and wherein the third tube is continuous with the fourth tube at respective first ends thereof and the third and fourth speakers are positioned between the third and fourth outlets on either side of and a distance from the centerline of an acoustic path formed by the third and fourth tubes such that a tube length between the third speaker and the third outlet is less than a tube length between the third speaker and the fourth outlet, a tube length between the fourth speaker and the fourth outlet is less than a tube length between the fourth speaker and the third outlet, the tube length between the third speaker and the third outlet is substantially the same as the tube length between the fourth speaker and the fourth outlet and the tube length between the third speaker and the fourth outlet is substantially the same as a tube length between the fourth speaker and the third outlet.

24. The headset apparatus of claim 23 wherein the first and second speakers are front-left and front-right speakers and the first and second tubes connected adjacent thereto terminate in the anterior portion of left and right ear cups respectively, and wherein, the third and fourth speakers are rear-left and rear-right speakers and the third and fourth tubes connected adjacent thereto terminate in the posterior portion of left and right ear cups respectively.

25. The headset apparatus of claim 24 further comprising at least one bass speaker in each of the left and right ear cups for positioning adjacent each of the users first and second ears.

26. The headset apparatus of claim 23 further comprising at least one center speaker connected at the centerline of the acoustic path formed by the first and second tubes or the third and fourth tubes.

27. The headset apparatus of claim 23 wherein each speaker chamber is an acoustically sealed, ported or vented chamber with sound absorbing material on a rearwardly disposed interior surface thereof.

28. The headset apparatus of claim 23 wherein said outlets each flare outwardly.

29. The headset apparatus of claim 23 wherein the first and second tubes are provided with sound absorbing material therein between a respective first end thereof and a respective first or second speaker, and the third and fourth tubes are provided with sound absorbing material therein between a respective first end thereof and a respective third or fourth speaker.

30. The headset apparatus of claim 29 wherein the sound absorbing material substantially or partially blocks the first and second tubes and/or the third and fourth tubes.

31. The headset apparatus of claim 23 wherein the ear cups are perforated and provided with sound absorbing material on an inner surface thereof.

32. The headset apparatus of claim 23 further comprising an electronic controller to control emissions of the speakers.

33. The headset apparatus of claim 23 further comprising a slider joint between the ear cups and the first, second, third and fourth outlets for enabling adjustment of a connection length between the ear cups and the first, second, third and fourth outlets when the user ear is moved relative to the headset apparatus.

* * * * *